US006010371A

United States Patent [19]

Farley et al.

[11] Patent Number: 6,010,371

[45] Date of Patent: Jan. 4, 2000

[54] ELECTRICAL CONNECTOR

[75] Inventors: L. Scott Farley, Riverton; Dean T. Farrish, Salt Lake City; Russell D. Heyborne, West Valley; Kevin H. Johnson, West Jordan; Michael S. Nielson; Steven B. Shannon, both of Sandy, all of Utah

[73] Assignee: Abbott Laboratories, Abbott Park, Ill.

[21] Appl. No.: 08/842,414

[22] Filed: Apr. 24, 1997

[51] Int. Cl.[7] ..... H01R 23/02

[52] U.S. Cl. ..... 439/676

[58] Field of Search ..... 439/676, 670, 439/930, 460, 401

[56] References Cited

U.S. PATENT DOCUMENTS

| | | | |
|---|---|---|---|
| 3,017,602 | 1/1962 | Little . | |
| 3,065,445 | 11/1962 | Crimmins . | |
| 3,065,446 | 11/1962 | Robb et al. . | |
| 3,084,302 | 4/1963 | Braeutigam . | |
| 3,149,897 | 9/1964 | Martineck . | |
| 3,154,365 | 10/1964 | Crimmins . | |
| 3,258,831 | 7/1966 | Angele et al. . | |
| 3,696,319 | 10/1972 | Olsson . | |
| 3,820,058 | 6/1974 | Friend . | |
| 3,998,514 | 12/1976 | Hardesty . | |
| 4,068,912 | 1/1978 | Hudson, Jr. et al. . | |
| 4,188,086 | 2/1980 | Inouye et al. . | |
| 4,275,495 | 6/1981 | Boutcher, Jr. et al. . | |
| 4,373,766 | 2/1983 | Johnston . | |
| 4,786,259 | 11/1988 | Paul . | |
| 4,806,117 | 2/1989 | Johnston . | |
| 4,825,876 | 5/1989 | Beard . | |
| 4,875,875 | 10/1989 | Archer et al. | 439/401 |
| 5,015,197 | 5/1991 | Redmond et al. . | |
| 5,048,531 | 9/1991 | Spotts et al. . | |
| 5,074,039 | 12/1991 | Hillbish et al. . | |
| 5,135,002 | 8/1992 | Kirchner et al. . | |
| 5,147,215 | 9/1992 | Pritulsky . | |
| 5,178,563 | 1/1993 | Reed . | |
| 5,192,833 | 3/1993 | Gibson . | |
| 5,217,388 | 6/1993 | Brown . | |
| 5,399,107 | 3/1995 | Gentry et al. | 439/676 |
| 5,564,951 | 10/1996 | Attal et al. | 439/676 |

FOREIGN PATENT DOCUMENTS

| | | |
|---|---|---|
| 1440183 | 1/1969 | Germany . |
| 2223126 | 11/1972 | Germany . |
| 2704806 | 8/1978 | Germany . |
| 4127123 | 2/1993 | Germany . |

OTHER PUBLICATIONS

Federal Republic of Germany, German Patent Office Patent Application No. 1,440,183, publication dated Oct. 15, 1996.

*Primary Examiner*—Steven L. Stephan
*Assistant Examiner*—J. F. Duverne
*Attorney, Agent, or Firm*—Neal D. Marcus

[57] ABSTRACT

A connector is provided for terminating a multi-conductor, flexible cable of the flat ribbon type which has a plurality of conductors in side-by-side parallel, spaced relationship within a web of encapsulating insulation from which projects a pre-stripped, bare, distal end portion of each conductor. The connector includes a housing defining a passage extending from an open first end to an open second end. The housing includes divider walls defining a plurality of slots each opening outwardly and each communicating with the passage at the second end. The housing has a support wall defining a bottom in each slot. An insulated length of cable can extend through the open first end of the housing passage toward the open second end where each bare, distal end portion of the conductor can be exposed and bent in one of the slots around the support wall adjacent a bottom of a slot.

25 Claims, 3 Drawing Sheets

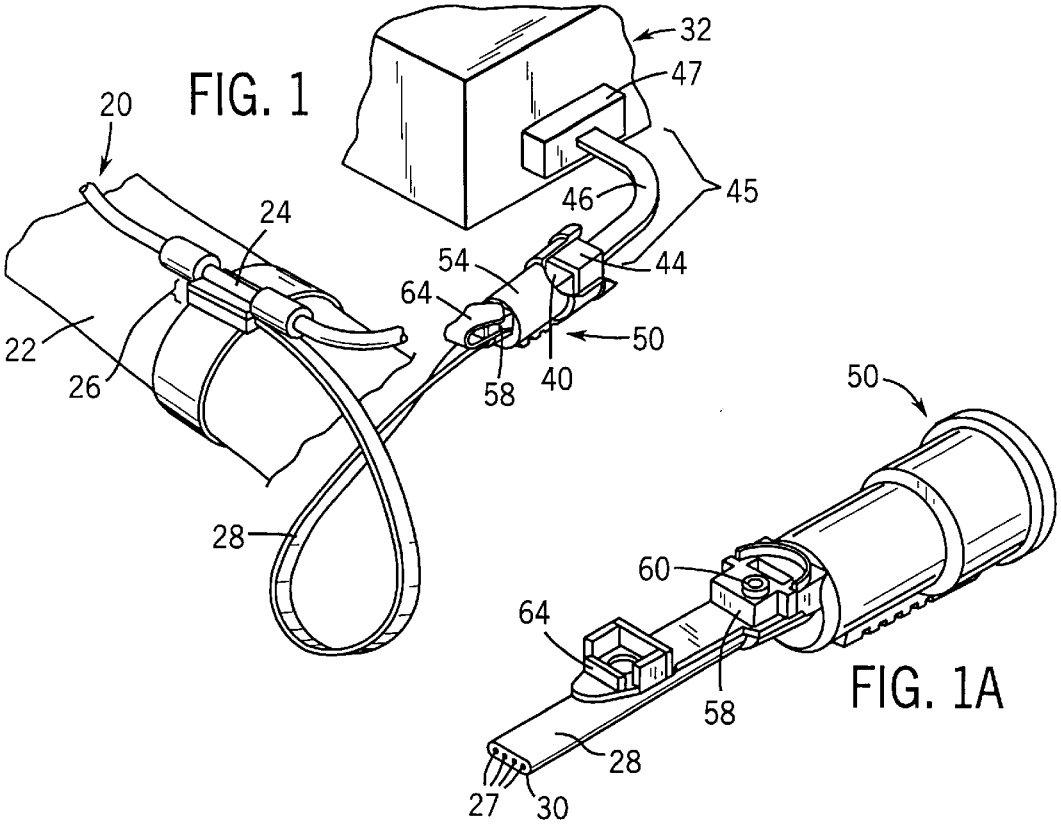
FIG. 1
20
24
22
26
28
32
47
46
45
44
54
64
50
58
40
50
60
64
58
28
27
30
FIG. 1A
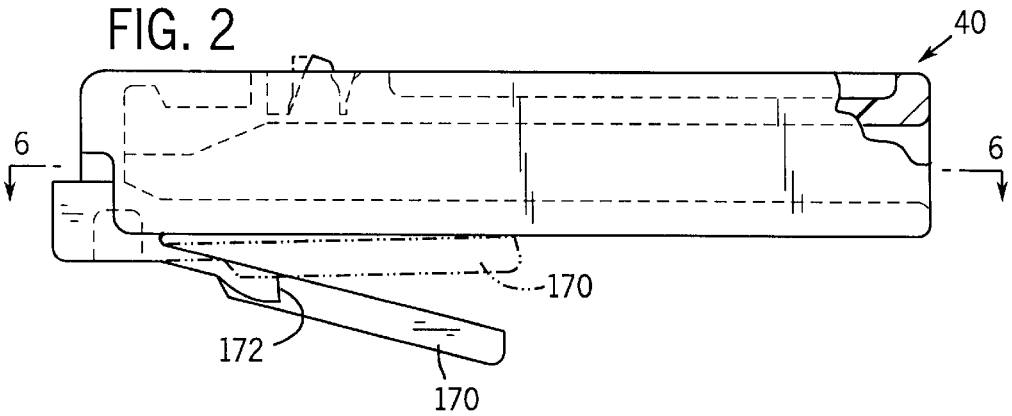
FIG. 2
40
6
6
170
172
170
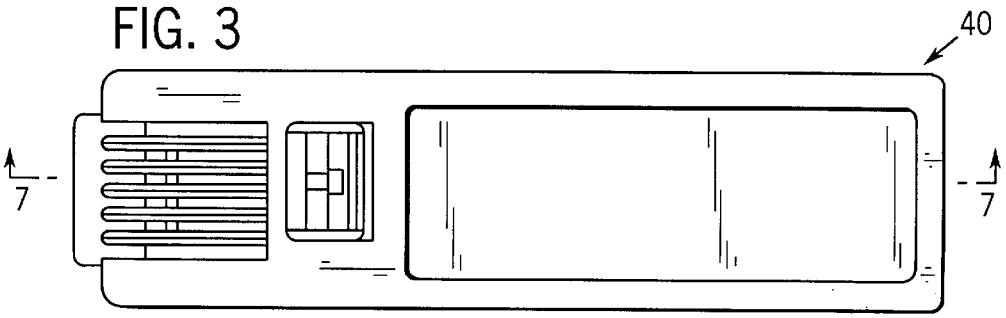
FIG. 3
40
7
7

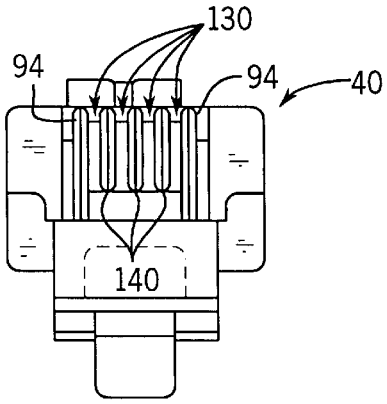
FIG. 4
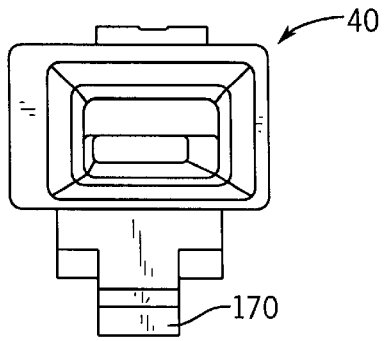
FIG. 5
FIG. 6
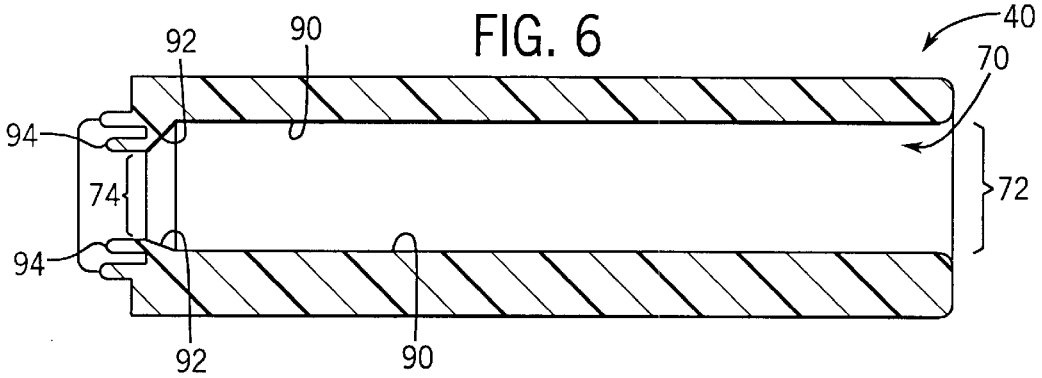
FIG. 7
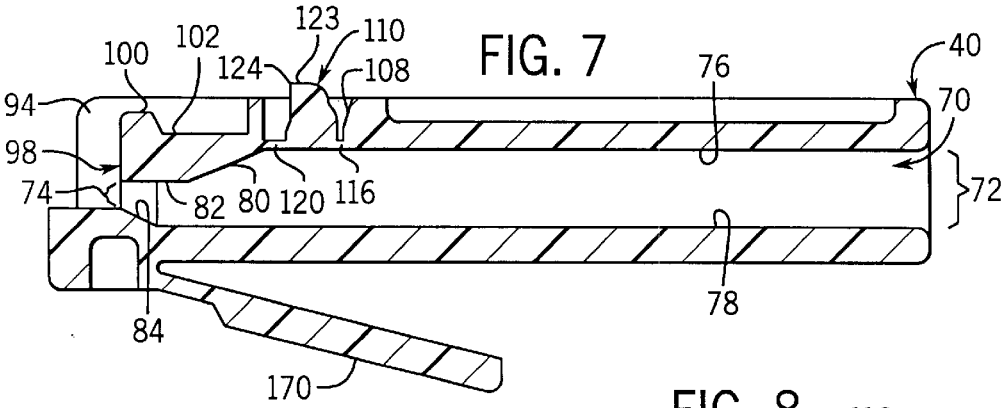
FIG. 8
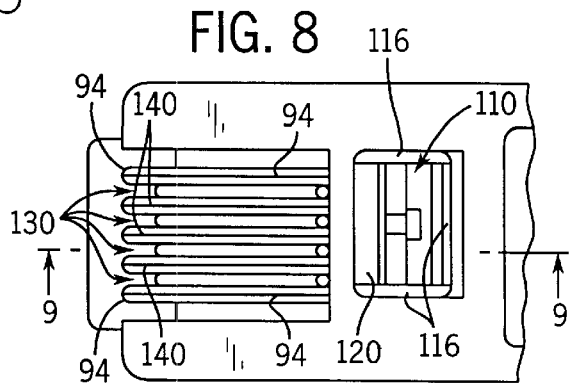

FIG. 9
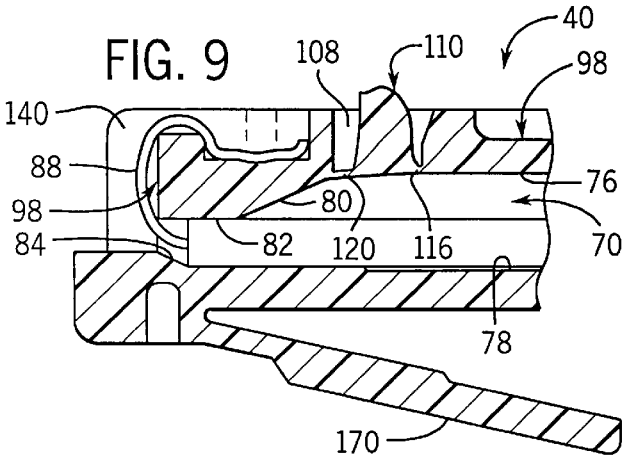
FIG. 10
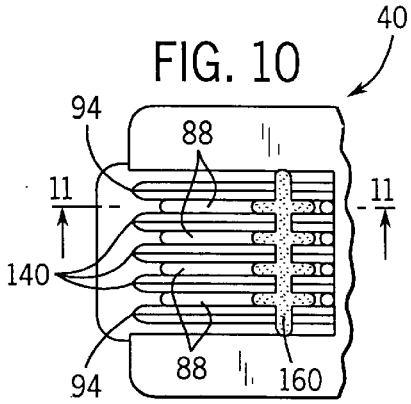
FIG. 11
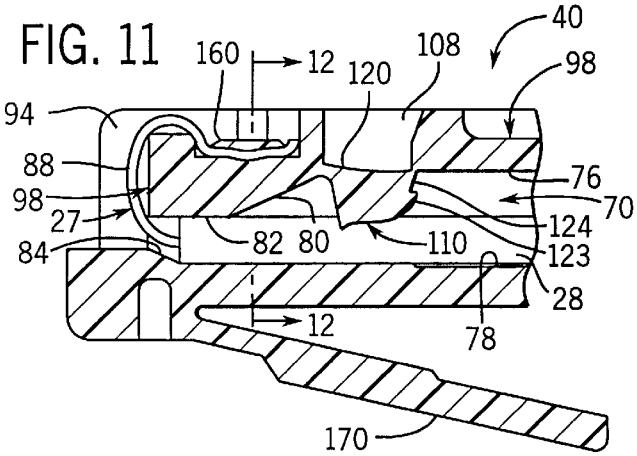
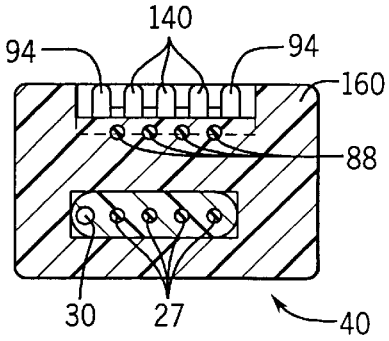
FIG. 12
FIG. 13
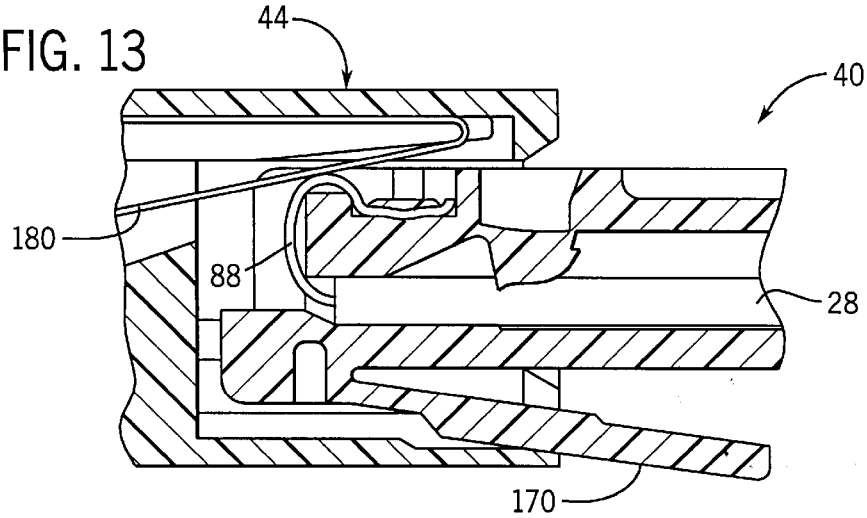

ELECTRICAL CONNECTOR

CROSS REFERENCE TO RELATED APPLICATION(S)

Not Applicable

STATEMENT REGARDING FEDERALLY SPONSORED RESEARCH OR DEVELOPMENT

Not Applicable

REFERENCE TO A MICROFICHE APPENDIX

Not Applicable

TECHNICAL FIELD

The present invention relates to connectors for terminating a multi-conductor, flexible cable of the flat ribbon type having a plurality of conductors which are in side-by-side, parallel, spaced relationship within a web of encapsulating insulation. The invention is suitable for, among other things, medical instrumentation, including medical apparatus sensors which employ cables wherein each conductor comprises a single strand of wire rather than multiple, twisted strands of wire. The invention is particularly suitable for instrumentation cable which includes a lumen that extends through the cable parallel to the conductors and that is subjected to various internal pressures during different modes of operation.

BACKGROUND OF THE INVENTION AND TECHNICAL PROBLEMS POSED BY THE PRIOR ART

Many kinds of electrical apparatus, instrumentation, components, and the like are connected to a power supply and/or another device with a multi-conductor, flexible cable. Such a cable typically has a plurality of conductors which are in side-by-side, parallel, spaced relationship within a web of encapsulating insulation which is usually a thermoplastic material.

Each conductor may be formed from multiple, twisted strands of wire. In some applications, it is preferred to use only a single strand of wire for each conductor.

For example, a single, solid strand of wire is used for each of the four parallel conductors in a flat flexible cable provided with the blood pressure sensor system sold in the United States of America under the brand name Transpac® IV by Abbott Laboratories, Inc., One Abbott Park Road, Abbott Park, Ill., 60064-3500, U.S.A. The Transpac®IV blood pressure sensor system includes a blood pressure transducer system which is electrically powered and which generates an electrical signal with voltage corresponding to the pressure of the blood in the system.

The transducer system includes a silicon chip with a thin wall functioning as a pressure-sensitive diaphragm. The strain-responsive thin wall or diaphragm of the silicon chip defines a strain-responsive integrated circuit. One side of the thin wall or diaphragm is subjected to the blood pressure, and an opposite side or "back side" of the chip thin wall or diaphragm is sealed in a chamber. The chamber is in communication with a lumen or passageway extending through the flexible cable insulation in parallel relationship with the four spaced-apart, single strand wire conductors. The conductors provide power to the integrated circuit on the silicon chip and carry from the integrated circuit the generated signal which corresponds to the blood pressure.

For calibration purposes, before the system is connected to a patient, a vacuum (i.e., a reduced pressure) may be drawn with a suitable vacuum apparatus connected to the cable lumen. The exterior or back side of the integrated circuit chip diaphragm can thus be subjected to a predetermined reduced pressure while the side of the diaphragm that would normally be exposed to the blood pressure is at ambient atmospheric pressure. The pressure differential simulates an operating system pressure differential that would arise when the system is connected to a patient, and the patient's blood pressure acts upon one side of the diaphragm while ambient atmospheric pressure acts on the other side of the diaphragm.

In the Transpac®IV blood pressure sensor system, the ends of the cable conductors are electrically connected to the strain-responsive integrated circuit on the silicon chip diaphragm. The strain-responsive integrated circuit is a suitable bridge circuit which can function generally like a Wheatstone bridge circuit or similar circuit. At the other end of the cable, a connector is provided for releasably connecting the cable to a monitor unit which supplies power to the integrated circuit and which monitors the signal generated by the integrated circuit. The connector at the end of the cable is adapted to be received in a jack connected to the monitor unit. The cable end connector and jack are similar to a conventional telephone connector and jack, respectively, that are commonly used in the United States of America.

The Transpac®IV connector, like the telephone connector, accommodates four conductors in a cable. However, the four-conductor cable of the Transpac®IV system also includes the lumen extending parallel to the four conductors, and the connector at the end of the Transpac®IV system cable accommodates that arrangement. In addition, in the Transpac®IV system, each conductor comprises a single strand of wire rather than multiple, twisted strands of wire typically employed in telephone cables.

The lumen in the Transpac® system cable is accessible via an aperture through the cable insulation adjacent the connector, and the access aperture is normally sealed closed by a removable plug in a rubber boot which is disposed around the portion of the cable and connector.

In order to draw a vacuum in the lumen in the Transpac®IV system cable, there must be essentially no leakage within the cable along the four conductors. If conventional, multiple, twisted strand wire is used for each conductor, then air can leak along the twisted strands of each conductor into the evacuation chamber adjacent the exterior side or back side of the transducer. To prevent such leakage, the Transpac®IV cable system employs only a single strand wire for each conductor, and each single strand of wire is encapsulated by the cable insulation material along its length.

The connector at the end of the Transpac®IV system cable includes a housing for receiving an insulated end portion of the cable. The four spaced-apart, parallel, single strand conductors are each contacted by a separate one of four, gold-plated spades or contact terminals that are each pushed through the cable insulation so as to engage a single strand conductor. The opposite end of each spade contact terminal is exposed in a slot in the connector housing and is adapted to engage a mating contact in the receiving jack attached to the monitor unit.

While the Transpac®IV system spade contact terminals function generally satisfactorily, they suffer from disadvantages. In particular, carefully controlled manufacturing techniques must be employed to avoid misalignment between each spade contact terminal and the single strand wire conductor as the spade contact terminal is pushed through the cable insulation.

It is difficult to establish contact between the spade contact terminal and the single strand conductor owing to (1) manufacturing tolerance variations in the diameter of each single strand connector and in the spacing between the connectors within the cable, and (2) variations in the insulation which may cause the spade contact terminal to move slightly to one side or the other as it is pushed through the insulation.

It is possible for the conductor to be missed altogether by the spade contact terminal. In other cases, only a very slight contact may exist between the inserted spade contact terminal and the conductor. In still other cases, the conductor may be completely severed by the spade contact terminal. These conditions can result in poor, intermittent, or non-existent electrical connections. As a result, the assembly process must maintain extremely close tolerances, and quality control must be sufficiently rigorous to identify completed assemblies that do not meet operational specifications. Accordingly, it would be desirable to provide an improved connector which could accommodate less stringent manufacturing techniques. Such an improved connector should preferably be less dependant upon close component tolerances.

Further, such an improved connector should preferably eliminate, or at least substantially minimize, problems associated with the integrity of the electrical connection between the cable conductors and the jack into which the connector is inserted.

It would also be advantageous to provide an improved connector which would (1) reduce the number of electrical connection points (which are areas of potential failure), (2) reduce the cost of production by minimizing the number of components, and (3) eliminate the use of more expensive components (e.g., gold-plated spades or contacts).

It would also be desirable to provide such an improved connector for being readily incorporated in configurations that can be received in, and mate with, a standard telephone jack.

The present invention provides an improved connector which can accommodate designs having the above-discussed benefits and features.

SUMMARY OF THE INVENTION

According to the present invention, a connector is provided for terminating flat cable, and the connector may be readily provided with a configuration for mating with a telephone jack of the type widely used in the United States of America.

The connector provides a reliable electrical connection when using single strand conductor wire as well as when using a conductor comprising multiple, twisted strands of wire.

The connector of the present invention employs a reduced number of components compared to conventional connectors.

Further, the connector of the present invention eliminates the use of more expensive components (e.g., gold-plated spade contacts).

Also, the connector of the present invention can be more readily manufactured in a way which is less dependent upon the dimensional tolerances of the cable and in a way which minimizes product rejects.

According to one aspect of the invention, an unattached connector is provided for terminating a multi-conductor, flexible cable. The cable is of the flat ribbon type. Such cable has a plurality of conductors in side-by-side parallel, spaced, relationship within a web of encapsulating insulation.

For use in the connector of the present invention, the cable insulation is pre-stripped to provide a bare distal end portion of each conductor. In the preferred mode of practicing the invention, each conductor is a single, solid wire conductor. However, multiple, twisted strand wire conductors may be employed with the connector of the present invention where air in-leakage along such a multiple strand conductor would not be a problem and where the use of a multiple strand conductor would not otherwise be unsuitable.

The connector of the present invention includes a housing defining a passage. The passage is open at a first end and at a second end for receiving an insulated length of cable extending through the open first end toward the open second end. At the open second end, the bare distal end portions of each conductor are exposed.

The housing defines a support wall at the open second end adjacent the passage. The housing has a plurality of generally parallel, spaced-apart divider walls extending beyond the support wall to define a receiving slot between adjacent divider walls. The slots each receive a respective one of the conductor bare distal end portions bent around a support wall.

In a preferred embodiment, the housing is molded as a unitary structure from thermoplastic material. Portions of the divider walls are melted and resolidified into a weld around the conductor bare distal end portions so as to anchor the distal end portions to the housing.

Further, another portion of the housing is preferably sheared and pivoted into the passage so as to establish clamping engagement with a portion of the insulated length of cable. This anchors the cable within the passage.

Another aspect of the invention is the completed assembly or combination of the connector and the multi-conductor flexible cable in an attached configuration. The connector includes a housing defining a passage open at first and second ends. The housing defines a support wall at the open second end adjacent the passage. The housing has a plurality of generally parallel, spaced-apart walls extending beyond the support wall to define a receiving slot between adjacent divider walls. The cable has an insulated length extending through the open first end of the housing toward the open second end. The bare distal end portion of each conductor extends from the passage out of the open second end and bends around the support wall.

Another aspect of the invention includes a combination of different features of the unattached connector which is provided for terminating the multi-conductor cable. The connector includes a housing defining a passage extending from an open first end to an open second end. The housing defines a plurality of slots each opening outwardly and each communicating with the passage at the second end. The housing has a support wall defining a bottom in each slot. The insulated length of the cable can extend through the open first end toward the open second end. The bare distal end portion of each conductor can be bent in one of the slots around the support wall adjacent the bottom of the slot where the bare distal end portion is exposed.

The invention also includes the completed assembly or combination of such a connector and a multi-conductor cable in an attached configuration. The connector includes a housing defining a passage extending from an open first end to an open second end. The housing defines a plurality of slots each opening outwardly and each communicating with the passage at the second end. The housing has a support wall defining a bottom in each slot. The cable has an insulated length extending through the passage open first end toward the open second end. The bare distal end portion of each conductor extends from the passage out of the open second end and is bent in one of the slots around the support wall adjacent the bottom of the slot.

The connector and cable assembly of the present invention provide a highly reliable connection which can be more readily manufactured.

Numerous other advantages and features of the present invention will become readily apparent from the following detailed description of the invention, from the claims, and from the accompanying drawings.

BRIEF DESCRIPTION OF THE DRAWINGS

In the accompanying drawings that form part of the specification, and in which like numerals are employed to designate like parts throughout the same, FIG. 1 is a perspective view of a blood pressure monitoring system incorporating the connector of the present invention;

FIG. 1A is a fragmentary, perspective view of the cable and boot shown in FIG. 1;

FIG. 2 is a side elevational view of the connector prior to installation of the connector housing on the end of a cable;

FIG. 3 is a top plan view of the connector;

FIG. 4 is a front end view of the connector;

FIG. 5 is a rear end view of the connector;

FIG. 6 is a cross-sectional view taken generally along the plane 6—6 in FIG. 2;

FIG. 7 is a cross-sectional view taken generally along the plane 7—7 in FIG. 3;

FIG. 8 is an enlarged, fragmentary view similar to FIG. 3, and FIG. 8 shows the connector after it has been disposed on the end of a multi-conductor cable but prior to deformation of portions of the connector to form a completed installation;

FIG. 9 is a fragmentary, cross-sectional view taken generally along the plane 9—9 in FIG. 8;

FIG. 10 is a view similar to FIG. 9, but FIG. 10 shows the connector after portions of the connecter have been deformed to complete the installation;

FIG. 11 is a cross-sectional view taken generally along the plane 11—11 in FIG. 10;

FIG. 12 is a view similar to FIG. 11, but FIG. 12 shows the installed connector plugged into a jack; and FIG. 13 is a fragmentary, cross-sectional view of the connector of FIG. 11 shown plugged into a jack.

DESCRIPTION OF THE PREFERRED EMBODIMENT

While this invention is susceptible of embodiment in many different forms, this specification and the accompanying drawings disclose only one specific form as an example of the invention. The invention is not intended to be limited to the embodiment so described, however. The scope of the invention is pointed out in the appended claims.

For ease of description, the connector of this invention is described in an arbitrary orientation or position, and terms such as upper, lower, horizontal, etc., are used with reference to this position. It will be understood, however, that the connector of this invention may be manufactured, stored, transported, used, and sold in an orientation other than the position described.

The connector of this invention is used with certain conventional components the details of which, although not fully illustrated or described, will be apparent to those having skill in the art and an understanding of the necessary functions of such components.

A preferred embodiment of the present invention is shown in FIG. 1 as part of a blood pressure monitoring system which is typically connected to a tubing set 20 through which an intravenous solution is administered into a blood vessel of a patient. The solution in the tubing 20 is thus essentially at the same pressure as the patient's blood circulating in the vessel. In FIG. 1, the tubing 20 is shown strapped to a patient's arm 22, and the illustrated portion of the tubing 20 contains a short length of rigid conduit 24 to which is attached a conventional integrated circuit type of pressure transducer system in a housing 26.

The pressure transducer system includes a silicon chip having a thin wall functioning as a pressure-sensitive diaphragm. One side of the diaphragm wall of the chip is typically referred to as the front side or interior side and is exposed to the intravenous solution which flows through the interior of the rigid conduit 24 at a pressure essentially equal to the patient's blood pressure. A pressure-sensitive integrated circuit which may function in a manner generally similar to a Wheatstone bridge circuit or similar circuit (not shown) inside the housing 26 is defined in the back side or exterior side of the thin wall or diaphragm of the silicon chip, and the circuit is connected to four conductors 27 (FIG. 1A) which extend in a cable 28 from the housing 26. Two of the conductors 27 define the complete power circuit for the excitation voltage, and two of the conductors 27 define the signal circuit. When the interior side of the silicon chip diaphragm in the conduit 24 is subjected to increased pressure, the diaphragm is expanded and subjected to strain. The bridge circuit in the silicon chip diaphragm generates a voltage signal corresponding to the blood pressure level.

The cable 28 containing the conductors 27 (i.e., the two signal conductors and the two power conductors) can be generally characterized as a multi-conductor, flexible, flat ribbon type of cable. Such a cable 28 has a plurality of conductors 27 in spaced-apart, side-by-side relationship within a web or jacket of encapsulating insulation.

The insulation or jacket of the cable 28 also defines a vent lumen 30 (FIGS. 1A and 12) which extends in the cable parallel to the conductors 27. At the silicon chip in the housing 26, the four conductors 27 project from the end of the cable insulation and are connected to the pressure-sensitive integrated circuit within a sealed chamber around the exterior side, or back side, of the chip diaphragm. The vent lumen 30 also opens from the end of the cable insulation into the chamber. The chamber is sealed around the cable insulation as well as over the integrated circuit on the silicon chip. As explained in detail hereinafter, a vacuum (i.e., a reduced pressure) can be drawn in the vent lumen 30 by suitable apparatus attached to the other end of the cable 28 so as to establish a reduced pressure in the chamber over the exterior side (i.e., back side) of the integrated circuit chip of the pressure transducer system. This is done when the intravenous solution tubing 20 is exposed to the atmospheric air pressure. This simulates the effect of the pressure of the patient's blood as would exist if an intravenous solution was actually being administered through the tubing 20 to the patient's blood circulatory system. This process is used to calibrate the pressure transducer system.

The cable 28 extends from the silicon chip transducer in the housing 26 to a monitor unit 32 which supplies power to the integrated circuit in the chip and which processes the voltage signal from the circuit for monitoring the blood pressure which corresponds to the transmitted signal. The present invention provides a novel male connector 40 (FIG. 1) which can be 20 toused to terminate the cable 28 and which is adapted to be readily connected to, and disconnected from, a suitable jack 44 that is connected to the monitor unit 32.

The male connector 40 of the present invention accommodates a variety of designs, including an exterior configuration which is adapted to be matingly received in a conventional telephone switching jack of the type that is widely used in the United States of America.

The blood pressure monitor unit 32 is typically provided by a manufacturer different than the manufacturer of the transducer, cable 28, and connector 40. Various manufacturers' blood pressure monitor units 32 do not all have the same, standard jack. Thus, a reusable connection system 45 is typically provided for installation on the monitor unit 32. One end of the reusable connection system 45 includes the standard jack 44 which is permanently attached to a cable 46. The other end of the cable 46 has a special plug 47 adapted to be received in the specific jack provided in the particular monitor unit 32. A typical conventional blood pressure monitor unit is sold in the United States of America under the designation Model No. 78532A by Hewlett-Packard Company, having an office at 3000 Minuteman Road, Andover, Mass. 01810.

In the preferred embodiment, the connector 40 is readily provided with a configuration that can accommodate a mating engagement with a six contact, six position, switching jack 44. The jack 44 may be of the type sold in the United States of America by Stewart Connector Systems, Inc., R.D. 2 Box 2020, Glen Rock, Penn. 17327, U.S.A., under the designation "Part No. SS-6488-NF-SJ, Six Contact, Six Portion, Switching Jack." Such a jack 44 will also matingly engage with a conventional four-conductor telephone connector of the type used in the United States of America.

The connector 40 of the present invention can be attached to the end of the cable 28 and then surrounded with a conventional, protective boot 50 of the type which is currently sold in the United States of America as part of the cable attached to the blood pressure transducer in the Transpac®IV system. The detailed structure and operation of such a boot forms no part of the present invention.

Briefly, during manufacture of the assembly of the transducer, cable 28, boot 50, and connector 40, the boot 50 is initially disposed loosely on the cable 28 prior to the attachment of the connector 40. After the connector 40 is attached to the cable 28 as described in detail hereinafter, the adjacent end portion of the cable 28 next to the connector 40 is engaged with the tip of a suitable ultrasonic welding tool so as to squeeze the lumen 30 closed and so as to seal the insulation together across the lumen 30. The boot 50 is then positioned at the end of the cable 28 to extend over the connector 40. The inner end of the boot 50 is then sealed around the cable insulation inwardly of both the welded closed portion of the lumen and the adjacent connector 40 as will next be explained.

The boot 50 includes a protective shroud 54 which extends outwardly around, but is spaced from, the connector 40. A rear portion 58 of the boot 50 extends over the cable 28 and defines a port 60 which is normally covered (but vented) by a hinged lid 64. In order to seal the boot 50 to the cable 28, the lid 64 is opened. A solvent is discharged into the port 60. The solvent flows by capillary action around the cable 28 inside the boot rear portion 58 to seal the cable 28 to the boot 50. The welded closed portion of the lumen 30 is located between the boot port 60 and the connector 40.

Next, an opening or hole is made in the cable insulation with a sharp tool extending through the open boot port 60 into the lumen 30. The opening in the cable insulation establishes communication between the boot port 60 and the lumen 30 within the cable 28. The boot lid 64 is then closed prior to packaging the system.

When the boot lid 64 is subsequently opened, a suitable vacuum apparatus system can be connected to the boot vacuum port 60. The vacuum apparatus can then be operated to draw a vacuum (i.e., reduce pressure) within the lumen 30. This effectively establishes a vacuum or reduced pressure on the back side or exterior side of the blood pressure transducer diaphragm. The vacuum can be drawn within the lumen 30 in the cable 28 via the boot port 60 because the lumen 30 is sealed closed at one end by the welded insulation under the boot 50 just outwardly of the port 60 and because the other end of the lumen 30 opens only to the sealed chamber over the back side of the integrated circuit chip diaphragm in the housing 26. A predetermined pressure reduction on the back side of the chip can be correlated to a blood pressure on the interior side of the chip exposed to the pressure within the conduit 24. In this manner, the integrated circuit chip transducer system can be calibrated when intravenous tubing 20 is exposed to atmospheric air pressure.

The above-described cable 28, boot 50, rigid conduit 24, pressure-sensitive integrated circuit chip of the transducer system, and the transducer system housing 26 are conventional components of the previously identified Transpac® system. Except for the structure of the cable 28, the detailed design and operation of such components form no part of the present invention.

Although an aspect of the present invention may be characterized as a combination of the novel connector 40 and the cable 28, it will be appreciated that the invention is readily adapted to accommodate ribbon-type cables having fewer than, or more than, the four parallel conductors employed in the Transpac® system cable.

In the preferred embodiment illustrated, each conductor 27 is a single strand, 28 gauge, solid, copper, conductor wire coated with a corrosive resistant coating such as tin. However, such a coating could also be gold, for example. In other applications, the corrosive resistant coating might be applied only to the exposed portions of the conductors or might be eliminated altogether.

The conductors 27 are equally spaced. The space between adjacent conductors 27 is about 0.0407 inch. The diameter of the lumen in the preferred embodiment is about 0.022 inch, and it is surrounded by a thickness of insulation which is preferably 0.01 inch thick or greater.

In the preferred embodiment illustrated, the width of the flat cable is about 0.20 inch and the thickness of the cable is about 0.0627 inch. The cable insulation is preferably a polyvinyl chloride jacket having a Shore durometer of 85A.

The connector 40 is preferably molded from a transparent, thermoplastic material to define a housing having a generally tubular configuration. However, the material need not be transparent. As shown in FIG. 11, the housing of the connector 40 defines a passage 70 for receiving the cable 28. With reference to FIG. 7, the passage 70 is open at a first end 72 and is open at a second end 74. The passage 70 is defined by a top surface 76 and a bottom surface 78. The top surface 76 and bottom surface 78 taper toward each other along the direction from the first end 72 to the second end 74. Near the second end 74, the top surface includes a steeply sloping portion 80 and a less steeply sloping outlet portion 82. The bottom surface 78 includes a more steeply sloping outlet portion 84 at the passage second end 74.

The passage opening at the second end 74 has a height which is less than the thickness of the cable 28. As shown in FIG. 11, when the cable 28 is installed in the passage 70, a distal end portion of the cable insulation is stripped away to expose a bare, distal end portion of each conductor 27, and the remaining edge of the cable insulation engages the passage top surface outlet portion 82 and passage bottom surface outlet portion 84.

Also, as shown in FIG. 6, the passage 70 is defined by two spaced-apart side surfaces 90 which taper toward each other along the direction from the first end 72 to the second end 74. Adjacent the second end 74, the side surfaces 90 each include a more inwardly angled abutment portion 92 for engaging the edge of the insulation of the cable 28. At the second end 74, a pair of spaced-apart divider walls 94 extend upwardly on either side of the second end 74.

The passage top surface 76, sloping portion 80, and outlet portion 82 may be characterized as being defined on the downwardly facing side of a support wall 98 (FIG. 7) which extends along the length of the connector 40 above the passage 70 and which varies in thickness along the length of the connector 40. As shown in FIG. 7, the support wall 98 at the passage second end 74 has a raised, distal portion 100 and has a recessed inner portion 102.

The wall 98 also defines a second recessed area or well 108 (FIGS. 7 and 8). The well 108 contains a strain relief tab 110 which is connected about its periphery by a frangible, reduced thickness connecting web 116 of a thermoplastic material to a first adjacent region of the connector housing. The remaining periphery of the strain relief tab 110 is permanently connected to a second adjacent region of the housing to define a hinge connection 120 (FIG. 7).

The strain relief tab 110 has an upper cam surface 123 (FIG. 7). The strain relief tab 110 also has a distal tip 124 (FIG. 7). The height of the tip 124 exceeds the length of the tab 110 as measured along the length of the connector 40 between the hinge connection 120 and the opposite connecting web 116.

When the cable 28 is inserted into the housing of the connector 40 as illustrated in FIG. 9, the strain relief tab 110 can be pushed downwardly with a suitable tool so as to break the frangible connecting web 116 around three sides of the tab 110 and so as to pivot the tab 110 about the hinge connection 120. The tab 110 can be pushed downwardly into a clamping position below the adjacent portion of the support wall 98 where the tab 110 engages, and digs into, the portion of the insulation on the cable 28 to securely grip the cable 28 and clamp it against the passage bottom surface 78. The tab 110 is initially carried past the bottom edge of the support wall 98. The tab distal tip 124 then engages the bottom edge of the support wall 98, and the tab 110 is thus prevented from springing back upwardly by that engagement.

The front end of the connector 40 defines a plurality of slots 130 (FIGS. 4 and 8) which each open outwardly and which each communicate with the passage 70 at the second end 74. The end of the housing support wall 98 above the passage second end 74 defines a bottom in each slot 130. That is, with reference to FIG. 7, the surface of the support wall 98 at the recess 102 and at the adjacent raised portion 100 defines a bottom of each slot 130.

In the preferred embodiment illustrated, the slots 130 are defined between vertical walls, such as the exterior divider walls 94 and a plurality spaced-apart interior divider walls 140 (FIGS. 4 and 8). The walls 94 and 140 extend beyond the support wall 98 to define the receiving slots 130.

Each slot 130 receives a pre-stripped bare, distal end portion 88 of a conductor 27. Each end portion 88 is bent around the end of the support wall 98 as shown in FIGS. 8 and 9. The end portions 88 are retained within the slots 130 by melting portions of the adjacent divider walls 94 and 140 and allowing the melted portions to resolidify to form a weld 160 (FIGS. 10–12) of thermoplastic material over portions of the conductor bare, distal end portions 88. This may be accomplished by employing a suitably configured tool which is adapted to be pushed down on top of each of the divider walls 94 and 140 while ultrasonic energy is directed into the tool. The ultrasonic vibrations melt the thermoplastic material of each divider wall, and the force of the tool forms the melted material into a suitable configuration which, upon resolidification, forms an effective weld 160 retaining the ends of the conductor bare, distal end portions 88 within the connector slots 130. However, even in the absence of ultrasonic energy, mechanical deformation (e.g., via a crimping tool) of the thermoplastic material of each divider wall 94 and 140 can also form a suitable means for retaining the ends of the conductor bare, distal end portions 88 within the connector slots 130.

The bottom of the connector 40 is also preferably provided with a conventional, cantilevered latching lever 170 (FIGS. 2, 11, and 13). The lever 170 includes a pair of conventional, rearwardly facing, latching shoulders 172 which are adapted to engage complementary abutment shoulders on a receiving jack, such as the jack 44 (FIGS. 1 and 13) in the well-known manner.

As illustrated in FIG. 13, when the connector 40 is inserted into the jack 44, the conductor bare, distal end portions 88 engage spring contact terminals 180 mounted in the jack 44, and this completes an electrical connection. Electrical contact in this jack 44 is established directly with the conductors 27 in the cable 28 unlike in conventional connectors where an intervening, separate, spade-type contact terminal member is interposed between each cable conductor and the mating spring contact terminal in the jack.

The connector 40 of the present invention thus eliminates a separate, and troublesome component required in the prior, conventional connectors used in the Transpac® IV system. Further, connector 40 of the present invention can be readily manufactured in a way which is less dependent upon dimensional tolerances of the cables and in a way which minimizes project rejects.

In the presently contemplated commercial embodiment, the connector 40 is molded from a suitable, transparent, thermoplastic material (e.g., polycarbonate) and has a length of about 1.25 inches and a width of about 0.38 inch. The thickness of the tubular portion of the connector is about 0.26, inch, and the latching lever 170 projects downwardly below the tubular portion.

About one half inch of insulation is stripped away from each conductor 27 at the distal end of the cable 28 prior to the cable 28 being inserted into the housing 40. Each divider wall 94 and 140 adjacent the bare, distal end portions 88 of the cable conductors 27 projects outwardly beyond the front end of the support wall 98 by about 0.06 inch. Each divider wall projects upwardly beyond the bottom of the upper recess 102 (FIG. 7) by about 0.06 inch. Each divider wall projects upwardly beyond the support wall raised portion 100 (FIG. 7) by about 0.03 inch.

The well 108 from which the strain relief tab 110 projects (FIGS. 7 and 8) is generally rectangular and measures about 0.113 inch by 0.164 inch. The well 108 has a depth of about 0.072 inch. The thickness of the strain relief tab hinge connection 120 is about 0.012 inch, and the frangible connecting webs 116 are slightly thinner.

It will be readily apparent from the foregoing detailed description of the invention and from the illustrations thereof that numerous variations and modifications may be effected without departing from the true spirit and scope of the novel concepts or principles of this invention.

What is claimed is:

1. A male connector for terminating a multi-conductor, flexible cable of the flat ribbon type having a plurality of conductors in side-by-side, parallel, spaced relationship within a web of encapsulating insulation from which projects a pre-stripped bare distal end portion of each said conductor, said connector comprising a housing defining a passage open at first and second ends for receiving an insulated length of said cable extending through said open first end toward said open second end where said bare distal end portions of each said conductor are exposed:

said housing defining a support wall at said open second end adjacent said passage; and said housing having a plurality of generally parallel, spaced-apart divider walls, said divider walls extending beyond said support wall to define a receiving slot between adjacent divider walls for receiving a respective one of said conductor bare distal end portions bent around said support wall so that said conductor bare distal end portions can directly matingly engage with contacts of another connector, said divider walls extending beyond a respective one of said conductor bare distal end portions bent around said support wall.

2. The connector in accordance with claim 1 in which said housing is molded as a unitary structure from a thermoplastic material;

said passage is defined in part by one side of a strain relief tab formed as part of said housing;

said strain relief tab is connected about a portion of its periphery by a frangible, reduced thickness connecting web of said thermoplastic material to a first adjacent region of said housing, the remaining periphery of said strain relief tab being permanently connected to a second adjacent region of said housing to define a hinge connection; and said strain relief tab has a distal tip with a height which exceeds the length of said tab between said hinge connection and said connecting web as measured in the plane of said connecting web along a line normal to the pivot axis of said hinge connection whereby a sufficient force applied to said strain relief tab can rupture said connecting web and pivot said tab about said hinge connection to a clamping position below said housing first adjacent region and against said cable so as to clamp said cable in said passage and whereby said tab is maintained in said clamping position by engagement of said tab distal tip with said housing first adjacent region.

3. The connector in accordance with claim 1 in which said passage is defined in part by spaced-apart top and bottom surfaces which taper toward each other along the direction from said first end to said second end; and said passage is defined in part by two spaced-apart side surfaces which taper toward each other along the direction from said first end to said second end.

4. The connector in accordance with claim 1 in which said housing includes a tubular portion defining said passage.

5. The connector in accordance with claim 1 in which each said conductor is a single strand of solid wire.

6. The connector in accordance with claim 5 in which each of said wire conductors includes a corrosive resistant coating.

7. The connector in accordance with claim 6 wherein said corrosive resistant coating is tin.

8. The connector in accordance with claim 1 in which said divider walls extend generally beyond said open second end of said passage.

9. The connector in accordance with claim 1 in which each said slot opens outwardly in two mutually perpendicular directions.

10. The connector in accordance with claim 1 in which said support wall has a raised distal portion and a recessed inner portion.

11. The connector in accordance with claim 1 in which said passage has a reduced width and height adjacent said second end which is less than the width and height, respectively, of said cable.

12. A male connector for terminating a multi-conductor, flexible cable of the flat ribbon type having a plurality of conductors in side-by-side, parallel, spaced relationship within a web of encapsulating insulation from which projects a pre-stripped bare distal end portion of each said conductor, said connector comprising a housing defining a passage extending from an open first end to an open second end; said housing defining a plurality of slots each opening outwardly and each communicating with said passage at said second end; and said housing having a support wall defining a bottom in each said slot whereby an insulated length of said cable can extend through said open first end toward said open second end where each bare distal end portion of the conductor can be exposed and bent in one of said slots around said support wall adjacent a bottom of said one slot so that said bare distal end portions can directly matingly engage contacts of another connector;

said housing has a plurality of space-apart divider walls defining said slots which extend beyond a distal end portion of a respective conductor in said slot.

13. The connector in accordance with claim 12 in which said housing includes a cantilevered latching lever defining a pair of rearwardly facing latching shoulders for engaging complementary abutment shoulders on a jack for receiving said connector.

14. The connector in accordance with claim 12 in which said support wall defines a raised distal portion and a rearward inner portion.

15. The connector in accordance with claim 12 in which said passage has a cross section which decreases in size along the direction from said first end to said second end.

16. A connector and cable assembly comprising a connector and a multi-conductor, flexible cable of the flat ribbon type having a plurality of conductors in side-by-side, parallel, spaced relationship within a web of encapsulating insulation from which projects a pre-stripped bare distal end portion of each said conductor;

said connector including a housing defining a passage open at first and second ends;

said housing defining a support wall at said open second end adjacent said passage;

said housing having a plurality of generally parallel, spaced-apart divider walls extending beyond said support wall to define a slot between adjacent divider walls for receiving and a bare distal end portion of said conductor so that said bare distal end portions can directly matingly engage with contacts of another connector; and said cable having an insulated length extending through said open first end toward said open second end, said bare distal end portion of each said conductor extending from said passage out of said open second end and bending around said support wall, said divider walls extending beyond the bare distal end portions of said conduces.

17. The assembly in accordance with claim 16 in which a portion of each said divider wall has been melted and resolidified into a weld around said conductor bare, distal end portions so as to anchor said distal end portions to said housing.

18. The assembly in accordance with claim 16 in which a portion of said housing has been sheared and pivoted into said passage and in clamping engagement with said cable.

19. A connector and cable assembly comprising a connector and a multi-conductor, flexible cable of the flat ribbon type having a plurality of conductors in a side-by-side, parallel, spaced relationship within a web of encapsulating insulation from which projects a pre-stripped bare distal end portion of each said conductor; said connector including a housing defining a passage extending from an open first end to an open second end;

said housing having a plurality of spaced apart divider walls defining a plurality of slots, each opening outwardly and each communicating with said passage at said second end;

said housing having a support wall defining a bottom in each said slot; and said cable having an insulated length extending through said open first end toward said open second end, said bare distal end portion of each said conductor extending from said passage out of said open second end and bending in one of said slots around said support wall so that said bare distal end portions can directly matingly engage with contacts of another connector;

said divider walls extending beyond said bare distal end portions of each conductors.

20. The assembly in accordance with claim 19 in which a portion of said housing has been melted and resolidified into a weld around said conductor bare, distal end portions so as to anchor said distal end portions to said housing.

21. The assembly in accordance with claim 19 in which each said conductor bare, distal end portion is bent a total of about at least 180° so that a part of each said distal end portion lies above said passage generally in registry over an insulated portion of the conductor that is within said passage.

22. The assembly in accordance with claim 16 in which portions of said divider walls have been mechanically deformed around said conductor bare, distal end portions, so as to anchor said distal end portions to said housing.

23. A male connector for terminating a multi-conductor, flexible cable of the flat ribbon type having a plurality of conductors in side-by-side, parallel spaced relationship within a web of encapsulating insulation from which projects a pre-stripped bare distal end portion of each said conductor, said conductor comprising a housing having:

a passage open at first and second ends for receiving an insulated length of said cable extending through said first open end toward said second open end where said bare distal end portions of each of said conductors are exposed; and means for supporting said distal end portions of each of said conductors; and means for defining a receiving slot for receiving a respective one of said conductor bare distal end portions bent around said means for supporting, so that said bare distal end portions can directly matingly engage contacts of another connector, said means for defining extending beyond said bare distal end portion bent around said support wall.

24. The connector of claim 23 wherein said means for supporting includes a support wall at said second open end adjacent said passage.

25. The connector of claim 24 wherein said means for defining a receiving slot includes a plurality of generally parallel, spaced-apart divider walls extending beyond said support wall.

* * * * *

UNITED STATES PATENT AND TRADEMARK OFFICE

CERTIFICATE OF CORRECTION

PATENT NO. : 6,010,371
DATED : January 4, 2000
INVENTOR(S) : L. Scott Farley et al.

It is certified that error appears in the above-identified patent and that said Letters Patent is hereby corrected as shown below:

Title page,
Item [54], Title, replace "ELECTRICAL CONNECTOR" with
-- ELECTRICAL CONNECTOR FOR CABLE --.

Signed and Sealed this

Twenty-seventh Day of August, 2002

*Attest:*

*Attesting Officer*

JAMES E. ROGAN
*Director of the United States Patent and Trademark Office*